US012714174B2

(12) United States Patent
Shih

(10) Patent No.: US 12,714,174 B2
(45) Date of Patent: Aug. 25, 2026

(54) BUFFERING STRUCTURE FOR PROTECTIVE GEARS

(71) Applicant: I-Hung Shih, New Taipei City (TW)

(72) Inventor: I-Hung Shih, New Taipei City (TW)

( * ) Notice: Subject to any disclaimer, the term of this patent is extended or adjusted under 35 U.S.C. 154(b) by 0 days.

(21) Appl. No.: 18/976,743

(22) Filed: Dec. 11, 2024

(65) Prior Publication Data

US 2026/0157466 A1 Jun. 11, 2026

(51) Int. Cl.
*A42B 3/20* (2006.01)
*A42B 3/12* (2006.01)

(52) U.S. Cl.
CPC . *A42B 3/20* (2013.01); *A42B 3/12* (2013.01)

(58) Field of Classification Search
CPC .. A42B 3/20; A42B 3/12; A42B 3/064; A42B 1/08; A63B 71/10; A63B 2071/1208; A63B 71/12; A63B 7/1225; A63B 2071/1233; A63B 2071/1241; A63B 2071/125; A63B 2071/1266; F16F 3/04; F16F 1/122; F16F 1/024; F16F 1/428; F16F 1/128; A41D 13/015; A41D 13/065; A41D 13/05; A41D 13/0506; A41D 13/0518
USPC ..... 2/9, 411, 424, 425
See application file for complete search history.

(56) References Cited

U.S. PATENT DOCUMENTS

| | | | | |
|---|---|---|---|---|
| 1,104,808 | A * | 7/1914 | Kockrow | A42B 3/06 2/6.1 |
| 1,112,358 | A * | 9/1914 | Cline | A61F 9/02 2/9 |
| 2018/0153244 | A1* | 6/2018 | Kirshon | B29C 39/025 |
| 2018/0228239 | A1* | 8/2018 | Day | F16F 1/126 |
| 2021/0219635 | A1* | 7/2021 | Pascua | F16F 3/04 |
| 2025/0031797 | A1* | 1/2025 | Corcoran | A42B 3/124 |

* cited by examiner

*Primary Examiner* — Grady Alexander Nunnery
(74) *Attorney, Agent, or Firm* — MUNCY, GEISSLER, OLDS & LOWE, P.C.

(57) ABSTRACT

The present invention provides a buffering structure for sport protective gears, including a first sheet, a second sheet, at least an elastic member, and a soft wrapper. The first sheet is provided with a first profile, the second sheet is provided with a second profile, and the at least one elastic member is clipped and fixed between the first sheet and the second sheet. At least part of the soft wrapper encloses the first sheet, the second sheet, and at least the one elastic member.

2 Claims, 6 Drawing Sheets

BUFFERING STRUCTURE FOR PROTECTIVE GEARS

BACKGROUND OF THE INVENTION

(a) Field of the Invention

The present invention relates to a buffering structure, and more particular to a buffering structure for protective gears.

(b) Description of the Prior Art

In all kinds of sport conditions, an athlete will usually wear all kinds of protective gears to protect him or her from being hurt by percussion or impact. For example, a baseball catcher, volley ball player, extremist, or football player, etc., will wear a protective mask or kneepads to prevent from percussion by a baseball or other players, or from hitting other objects by oneself.

The abovementioned conventional protective gears that are attached onto a body part (e.g., a protective mask is attached onto a forehead and jaw, whereas kneepads are attached onto knees), are normally made of soft foam pads, i.e. buffering structures. However, the space of elastic deformation for the foam pad is limited, meaning that the force of percussion or impact to be absorbed (or the buffering effect) will be limited, and the extent of protection for body parts is not ideal accordingly.

SUMMARY OF THE INVENTION

To solve all kinds of issues caused by the abovementioned conventional buffering structure for protective gears, the present invention provides a buffering structure for protective gears, comprising a first sheet, a second sheet, at least an elastic member, and a soft wrapper. The first sheet is provided with a first profile, the second sheet is provided with a second profile, and the at least one elastic member is clipped and fixed between the first sheet and the second sheet. At least part of the soft wrapper encloses the first sheet, the second sheet, and the at least one elastic member.

Accordingly, by the buffering structure for protective gears provided by the present invention, the elastic deformation of the elastic member can be utilized to absorb the percussion force, forming the buffering effect to protect body parts, so as to actually achieve the object of improving the buffering and protection effects.

In some unlimited modes of operation, the abovementioned at least one elastic member is at least a spring.

In some unlimited modes of operation, the abovementioned first sheet is bent into at least a first holding plate which winds to form a first hole, and one end of the at least one spring being is fixed into the first hole by rotation.

In some unlimited modes of operation, the abovementioned second sheet is bent into at least a second holding plate which winds to form a second hole, and the other end of the at least one spring is fixed into the second hole by rotation.

In some unlimited modes of operation, the abovementioned first sheet is provided with at least a first opening, and one end of the at least one spring is fixed into the first opening by rotation.

In some unlimited modes of operation, the abovementioned second sheet is provided with at least a second opening, and the other end of the at least one spring is fixed into the second opening by rotation.

In some unlimited modes of operation, the abovementioned at least one elastic member is at least one spring leaf.

In some unlimited modes of operation, the abovementioned at least one spring leaf is fixed into the first sheet by at least a first screw.

In some unlimited modes of operation, the abovementioned at least one spring leaf is fixed into the second sheet by at least a second screw.

In some unlimited modes of operation, the abovementioned at least one spring leaf is in an arc shape.

In some unlimited modes of operation, at least a part of at least one of the abovementioned first sheet and second sheet is in a bent shape.

In some unlimited modes of operation, at least one of the abovementioned first sheet and second sheet is an elastic iron plate.

In some unlimited modes of operation, the abovementioned soft wrapper is leather.

In some unlimited modes of operation, the abovementioned first profile is the same as the second profile.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
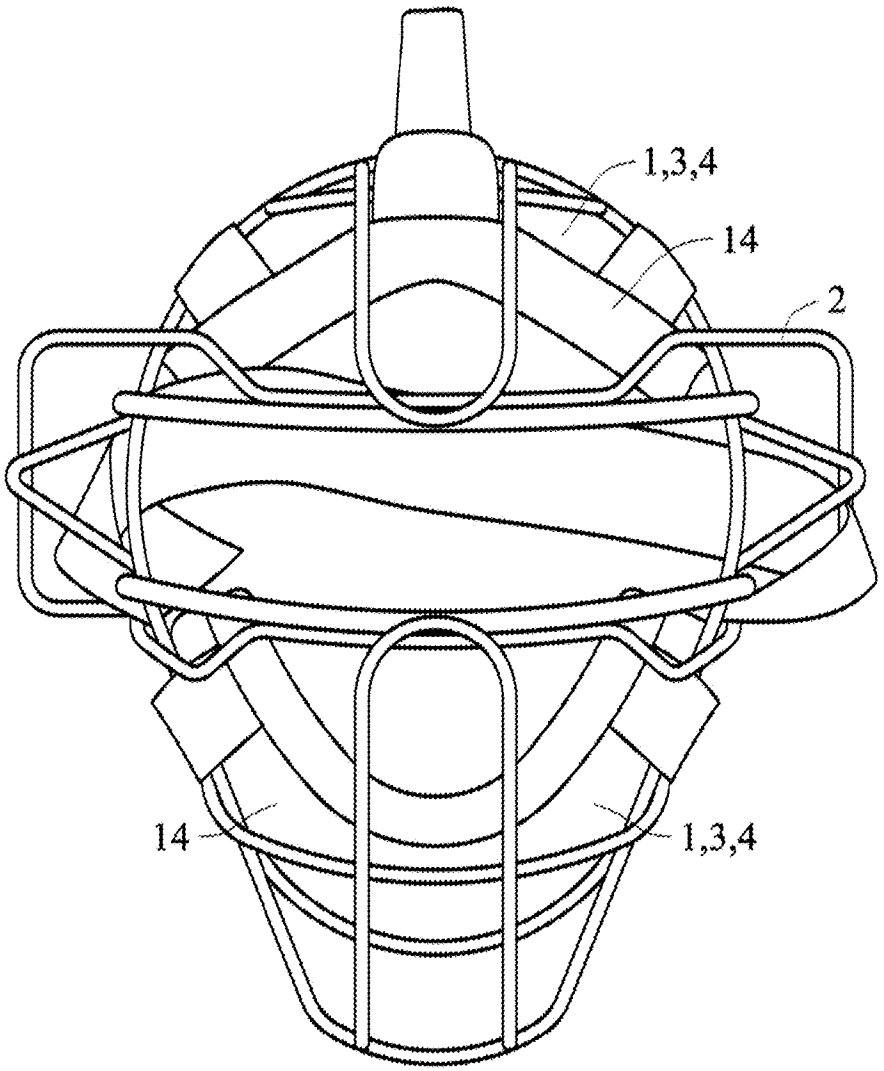
FIG. 1 shows a schematic view of a protective gear in a form of protective mask.

Referring to FIG. 1, it shows a protective gear 2 in a form of protective mask, wherein an upper part (attached onto a forehead) and a lower part (attached onto a jaw) of the protective gear 2 are provided respectively with a buffering structure 1. The buffering structure 1 can be utilized to absorb a percussion or impact force, forming a buffering effect to protect body parts from being hurt.

Figure 2:
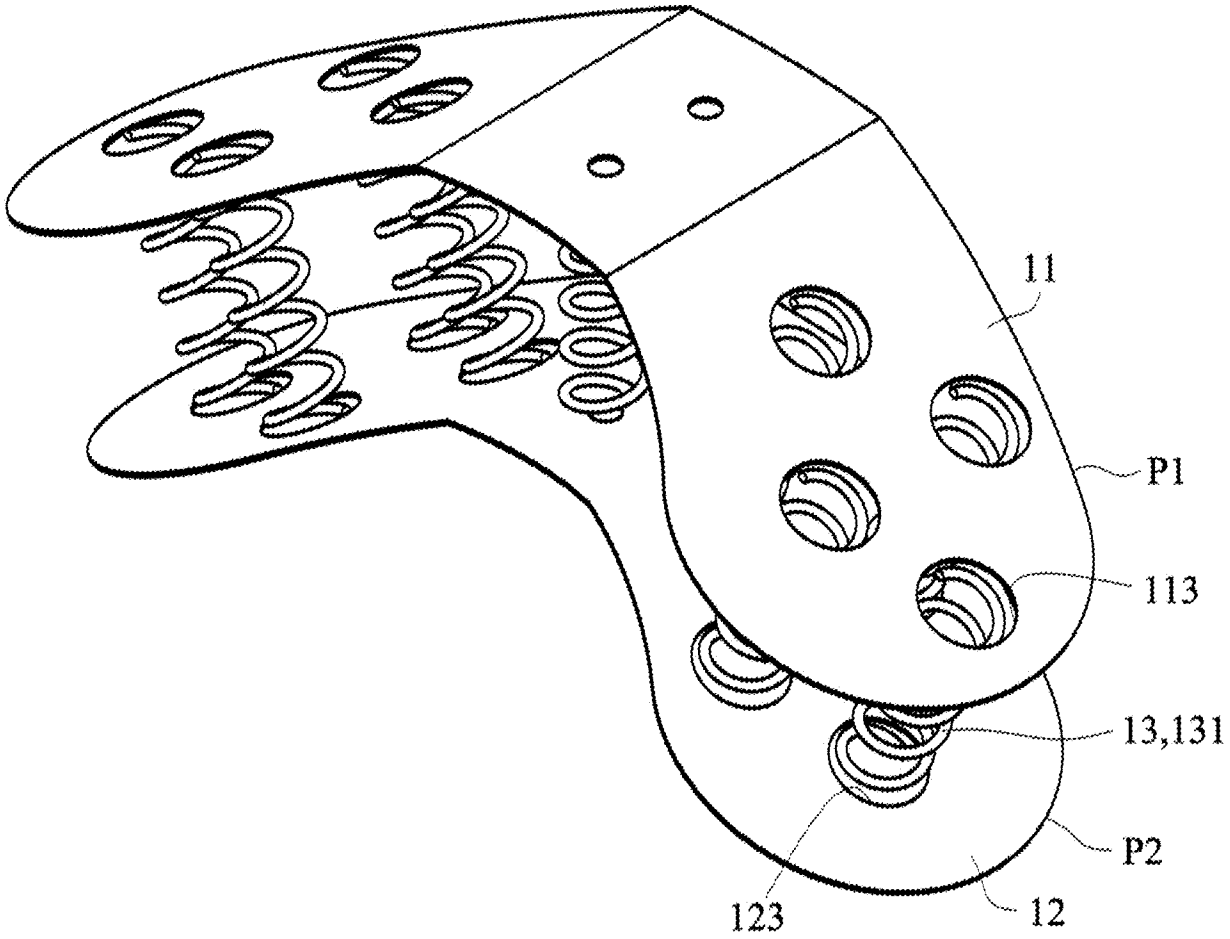
FIG. 2 shows a three-dimensional view of a first preferred embodiment of buffering structure, wherein the soft wrapper is removed to manifest other structures in detail.
Figure 3:
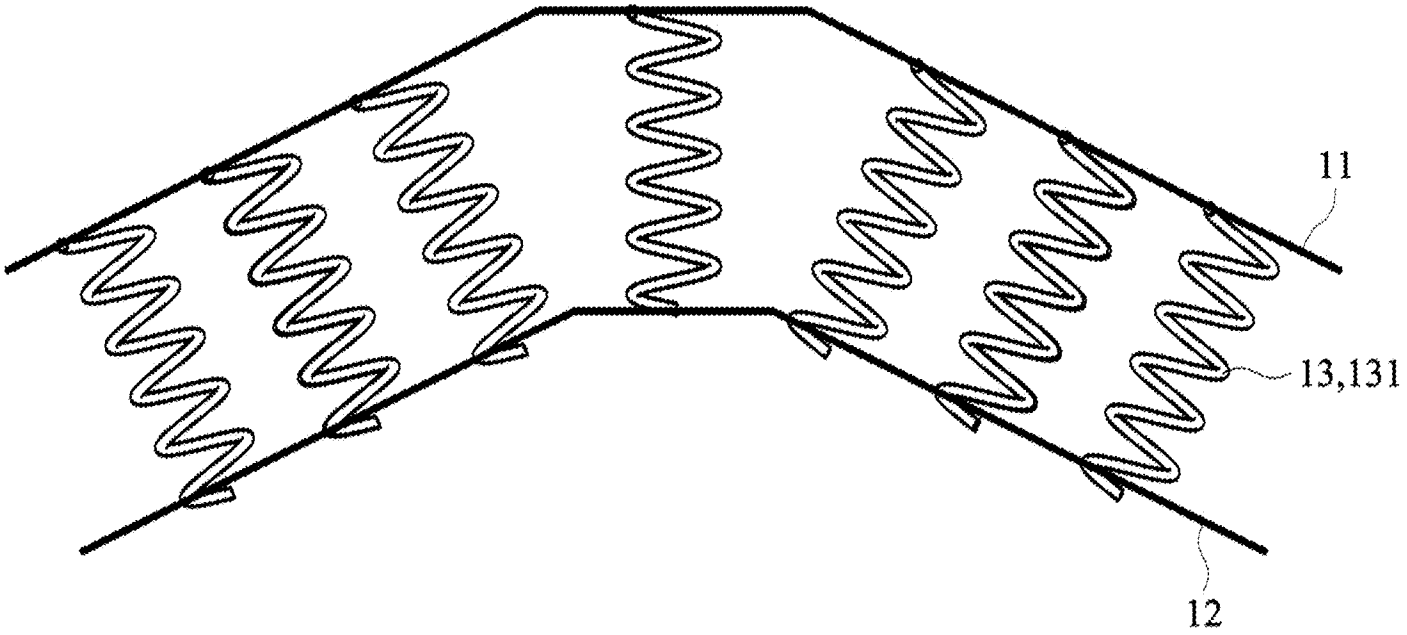
FIG. 3 shows a side view of the first preferred embodiment of buffering structure, wherein the soft wrapper is removed to manifest other structures in detail.

Referring to FIGS. 1 to 3, it shows the buffering structure 1 for protective gears 2, according to a first preferred embodiment of the present invention. The buffering structure 1 includes a first sheet 11, a second in sheet 12, at least an elastic member 13 and a soft wrapper 14, wherein the first sheet 11 is provided with a first profile P1, the second sheet 12 is provided with a second profile P2, the at least one elastic member 13 is clipped and fixed between the first sheet 11 and the second sheet 12, and at least part of the soft wrapper 14 encloses the first sheet 11, the second sheet 12, and the at least one elastic member 13.

There can be one or more elastic members 13 in the abovementioned buffering structure 1, and the elastic deformation of the elastic member 13 is utilized to form a buffering function to absorb a percussion (impact) force. In the present embodiment, the quantity of the elastic member 13 is plural and the elastic members 13 are springs 131 which are disposed on various locations between the first sheet 11 and the second sheet 12. There is no limitation to the distribution of the springs 131; for example, the springs 131 can be disposed more densely at some locations (such as the locations experiencing the percussion (impact) force more often) and more scarcely at other locations, as needed. In addition, all or part of the springs 131, or the springs 131 at different locations, can have different or same spring constants, spring diameters or spring line widths, as needed.

Referring to FIGS. 1 to 3 again, when an athlete wears the sport protective gear 2 having the abovementioned buffering structure 1; for example, when a baseball catcher wears the sport protective gear 2 in a form of protective mask as shown in FIG. 1 on his or her face, in the process of exercising, if the athlete is subjected to percussion (impact) or hits other object (like the baseball catcher's face is hit by a baseball), as the elastic member 13 (the springs 131 in the present embodiment) is provided with a certain deformation space to absorb the percussion force from the baseball to form the buffering effect utilizing the elastic deformation, the body part (such as the abovementioned face) can be protected from being hurt. Therefore, the structure design of this buffering structure 1 can indeed achieve the object of improving the buffering and protection effects in comparison to the conventional sport gear which is only provided with a foam pad.

On the other hand, the soft wrapper 14 in the abovementioned buffering structure 1 at least partly encloses the first sheet 11, the second sheet 12, and the elastic member 13. It means that the soft wrapper 14 can enclose the first sheet 11, the second sheet 12, and the elastic member 13 completely or partly. In the present embodiment, the soft wrapper 14 encloses the first sheet 11, the second sheet 12, and the elastic member 13 completely. As shown in FIG. 1, when the athlete wears the sport protective gear 2 having the abovementioned buffering structure 1, the soft wrapper 14 can be attached onto a body part, and the softness design of the soft wrapper 14 can improve the comfortableness in wearing the sport protective gear 2. Moreover, the soft wrapper 14 can also form the buffering effect to absorb the percussion (impact) force. The abovementioned soft wrapper 14 is leather in the present embodiment, and certainly can be a soft material such as foam or (sweat-absorbing) cloth.

Furthermore, the first profile P1 of the first sheet 11 and the second profile P2 of the second sheet 12 in the abovementioned buffering structure 1 can be designed according to the shape of body parts, meaning that the first profile P1 and the second profile P2 can be changed depending upon the body parts; for example, they can be changed according to the areas of the body parts to be protected, so as to increase the completeness of protection of the buffering structure 1 for the body parts of protection. In the present embodiment, the abovementioned first profile P1 is that same as the second profile P2, but they can be different naturally.

As shown in FIGS. 1 to 3, in the present embodiment, at least one of the first sheet 11 and the second sheet 12 in the buffering structure 1 is an iron plate, meaning that the first sheet 11, the second sheet 12, or both of them is an elastic iron plate. By using the elastic function, the first sheet 11 and the second sheet 12, along with the elastic member 13, can improve the buffering effect to absorb the percussion (impact) force.

In the present embodiment, the first sheet 11 in the buffering structure 1 is provided with plural first openings 113, and one end of each of the springs 131 is fixed into one of the first openings 113 by rotation, meaning that one end of the spring 131 will be locked into the first opening 113. Similarly, the second sheet 12 in the buffering structure 1 is also provided with plural second openings 123, and the other end of each of the springs 131 is fixed into one of the second openings 123 by rotation, meaning that the other end of the spring 131 will be locked into the second opening 123. Accordingly, the springs 131 can be disposed stably between the first sheet 11 and the second sheet 12. There can be one or more first openings 113 provided by the first sheet 11 as well as one or more second openings 123 provided by the second sheet 12, depending upon the quantity of springs 131.

Moreover, in the present embodiment, at least part of the first sheet 11 or the second sheet 12 in the buffering structure 1 is in a bent shape, meaning that all or part of the first sheet 11 or the second sheet 12 can be bent. This kind of design can be changed according to the shape of body part, so as to increase the fitness of buffering structure 1 to the body part.

Figure 4:
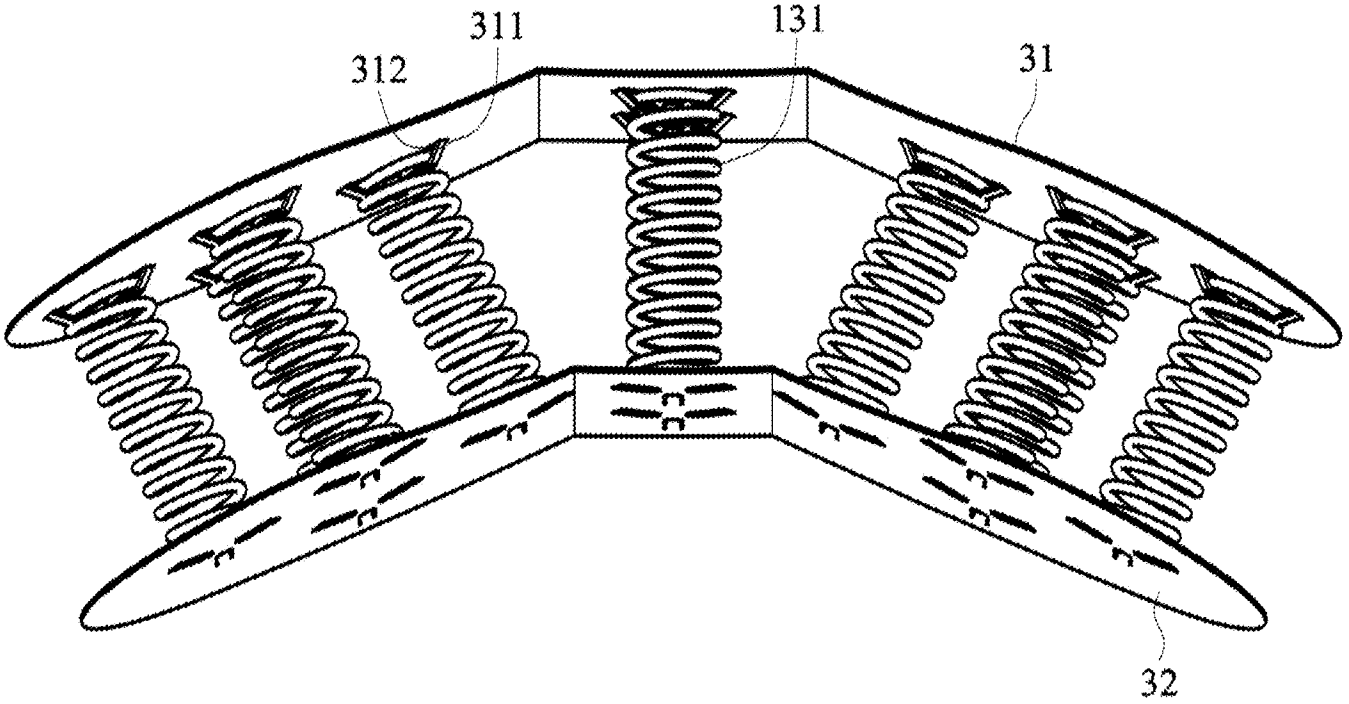
FIG. 4 shows a three-dimensional view of a second preferred embodiment of buffering structure, wherein the soft wrapper is removed to manifest other structures in detail.
Figure 5:
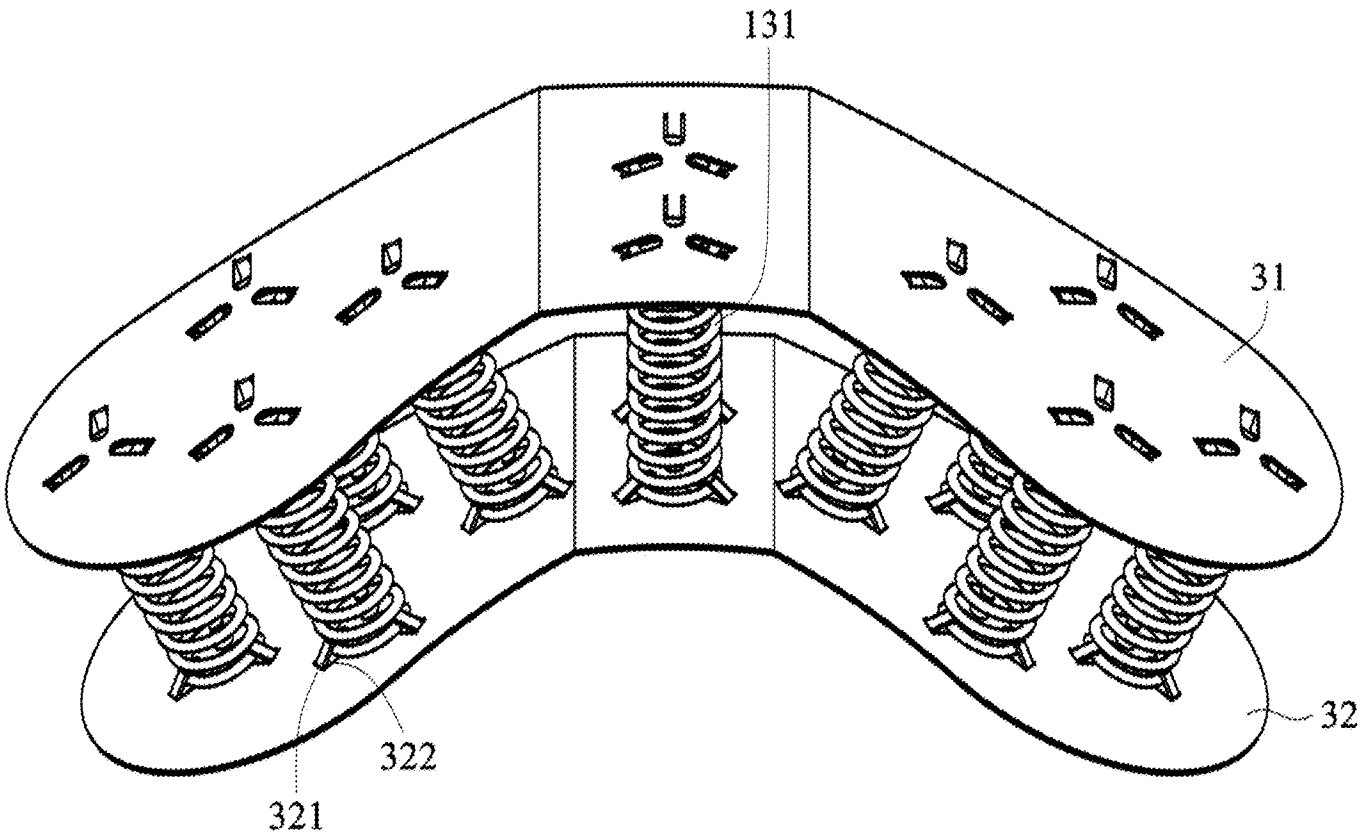
FIG. 5 shows another three-dimensional view of the second preferred embodiment of buffering structure, wherein the soft wrapper is removed to manifest other structures in detail.

Referring to FIGS. 1, 4, and 5, it shows a buffering structure 3 for sport protective gears 2 according to a second preferred embodiment of the present invention. In the present embodiment, the buffering structure 3 can also achieve all kinds of effects described in the abovementioned first preferred embodiment.

To be more specific, in the buffering structure 3 shown in FIGS. 1, 4, and 5, a first sheet 31 is bent into plural first holding plates 311, and each of the first holding plates 311 winds into a first hole 312. In addition, one end of each of the springs 131 is fixed into the first hole 312 by rotation. Similarly, a second sheet 32 is bent into plural second holding plates 321, and each of the second holding plates 321 winds into a second hole 322; whereas, the other end of one of the springs 131 is fixed into the second hole 322 by rotation. Accordingly, the springs 131 can be disposed stably between the first sheet 31 and the second sheet 32.

There can be one or more first holding plates 311 bent by the first sheet 31 as well as one or more second holding plates 321 bent by the second sheet 32, in the abovementioned buffering structure 3. In addition to that the quantity of first holding plates 311 and second holding plates 321 can be designed according to the quantity of springs 131, the quantity of first holding plates 311 and second holding plates 321 corresponding to each spring 131 can be also increased as needed to further improve the stability of springs 131 in fixing.

Figure 6:
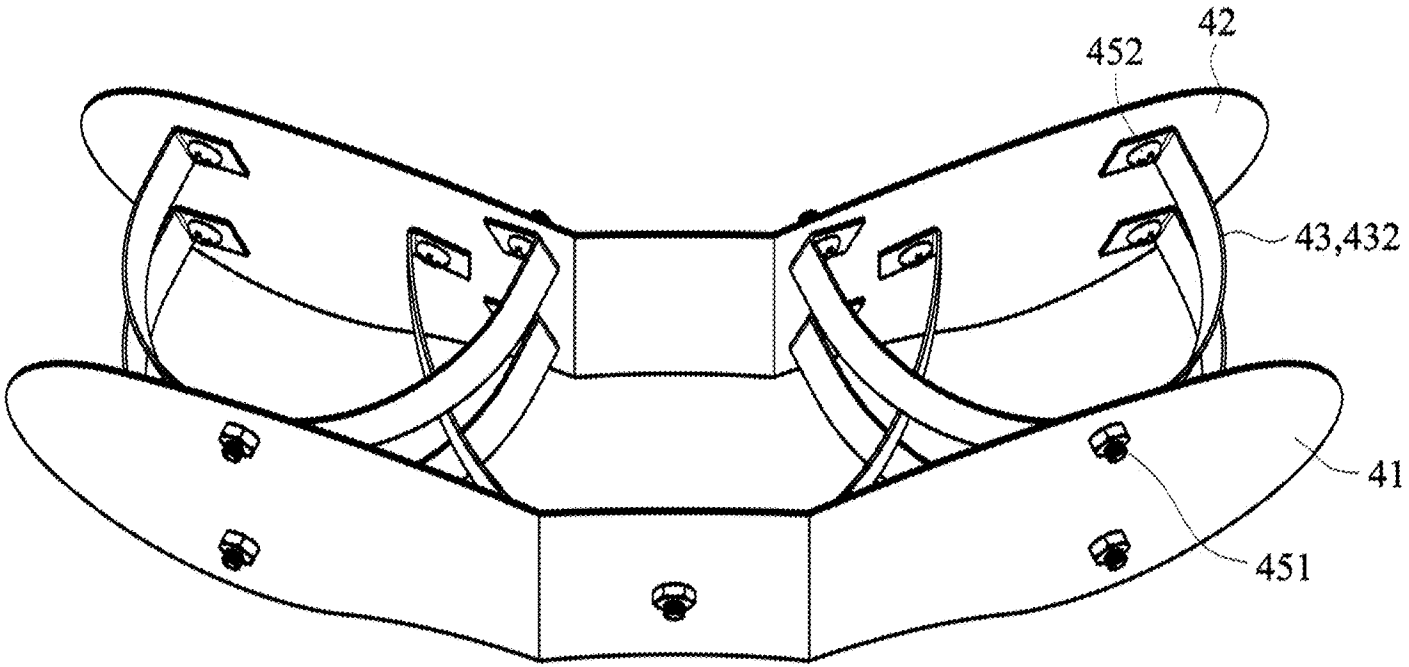
FIG. 6 shows a three-dimensional view of a third preferred embodiment of buffering structure, wherein the soft wrapper is removed to manifest other structures in detail.

Referring to FIG. 1 and FIG. 6, it shows a buffering structure 4 for sport protective gears 2 according to a third preferred embodiment of the present invention. In the present embodiment, the buffering structure 4 can also achieve all kinds of effects described in each abovementioned preferred embodiment.

To be more specific, in the buffering structure 4 as shown in FIG. 6, elastic members 43 are in a form of spring leaf 432, causing a buffering effect by utilizing the elastic deformation to absorb the percussion (impact) force to protect the body parts from being hurt. Similarly, the quantity of elastic member 43 (spring leaf 432) can be one or more as needed.

In addition, in the present embodiment, the abovementioned spring leaf 432 is in an arc shape. However, it can be also designed into a trapezoidal shape or polygonal shape, as needed.

Furthermore, as shown in FIG. 6, the spring leaf 432 is locked into the first sheet 41 by plural first screws 451. Similarly, the spring leaf 432 is also locked into the second sheet 42 by plural second screws 452. There can be one or more first screws 451 and second screws 452.

In the three preferred embodiments shown in FIGS. 2 to 6, to dispose the springs 131 between the first sheet 11 and the second sheet 12, dispose the springs 131 between the first sheet 31 and the second sheet 32, and dispose the spring leaves 432 between the first sheet 41 and the second sheet 42, welding, riveting, a mixing method of the two, or a combination of the methods above can be utilized as a fixing method.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A buffering structure for protective gears, comprising a first elastic iron sheet, which is provided with a first profile, the first elastic iron sheet is bent into plural first holding plates that wind into a first fixing hole;

a second elastic iron sheet, which is provided with a second profile, the second elastic iron sheet is bent into plural second holding plates that wind into a second fixing hole;

rotationally insertable springs, which are clipped and fixed between the first elastic iron sheet and the second elastic iron sheet, one end of one of said rotationally insertable springs is fixed into the first fixing hole by rotation and the other end of said one of said rotationally insertable springs is fixed into the second fixing hole by rotation; and cushioning soft material, part of which encloses the first elastic iron sheet, the second elastic iron sheet, and the rotationally insertable springs, wherein part of the first elastic iron sheet, the second elastic iron sheet, or both of the elastic iron sheets, is in a bent shape.

2. The buffering structure for protective gears according to claim 1, wherein the first profile is the same as the second profile.

* * * * *